US007293592B1

(12) United States Patent
Golicz et al.

(10) Patent No.: US 7,293,592 B1
(45) Date of Patent: Nov. 13, 2007

(54) FORMING AND APPLYING LINERLESS LABELS

(75) Inventors: Roman M. Golicz, Clinton, CT (US); William G. Gunther, Guilford, CT (US); Alfred L. Basso, Colebrook, CT (US)

(73) Assignee: George Schmitt & Co., Inc, Guilford, CT (US)

( * ) Notice: Subject to any disclaimer, the term of this patent is extended or adjusted under 35 U.S.C. 154(b) by 0 days.

(21) Appl. No.: 10/791,956

(22) Filed: Mar. 3, 2004

Related U.S. Application Data

(60) Provisional application No. 60/451,492, filed on Mar. 3, 2003.

(51) Int. Cl.
*B31F 1/00* (2006.01)

(52) U.S. Cl. ..... 156/459; 156/156; 156/556; 156/566; 198/406; 198/606

(58) Field of Classification Search ..... 156/156, 156/556, 566; 198/406, 606
See application file for complete search history.

(56) References Cited

U.S. PATENT DOCUMENTS

| | | | | | |
|---|---|---|---|---|---|
| 3,353,432 | A * | 11/1967 | Philippi | 83/176 |
| 4,069,727 | A | 1/1978 | Sparks et al. | 83/16 |
| 4,204,672 | A * | 5/1980 | Grivet | 271/188 |
| 4,650,533 | A | 3/1987 | Parker et al. | 156/219 |
| 4,840,696 | A * | 6/1989 | Krasuski et al. | 156/353 |
| 4,978,415 | A | 12/1990 | Jones | 156/517 |
| 5,431,763 | A | 7/1995 | Bradshaw | 156/256 |
| 5,445,369 | A * | 8/1995 | Golicz et al. | 271/3.23 |
| 5,487,915 | A | 1/1996 | Russ et al. | 428/43 |
| 5,674,345 | A * | 10/1997 | Nash | 156/264 |
| 5,783,032 | A | 7/1998 | O'Callaghan et al. | 156/556 |
| 5,803,635 | A | 9/1998 | Austin et al. | 400/708 |
| 5,824,178 | A * | 10/1998 | Shingu et al. | 156/265 |
| 5,853,117 | A | 12/1998 | Traise | 225/4 |
| 6,253,817 | B1 * | 7/2001 | Edwards et al. | 156/351 |
| 6,471,802 | B1 | 10/2002 | Williamson | 156/64 |
| 6,520,899 | B1 * | 2/2003 | Haggman | 493/105 |
| 6,655,435 | B2 | 12/2003 | Penati | |
| 6,783,622 | B1 * | 8/2004 | Backlund et al. | 156/250 |
| 6,845,799 | B2 * | 1/2005 | Francke et al. | 156/521 |

* cited by examiner

*Primary Examiner*—Philip Tucker
*Assistant Examiner*—Kimberly K McClelland
(74) *Attorney, Agent, or Firm*—C. Nessler

(57) ABSTRACT

Self-adhesive labels are formed by repetitively cutting linerless web material which is fed from a roll into and through a rotary knife cutter. The labels are then transported to and applied to articles. To improve cutting of the web and labeling, the web and or labels are contoured, e.g., they are made concave, in a plane transverse to the direction of flow path. To contour the web or labels, alternative endless belt arrangements are used, wherein the center line of the adhesive side of the web is adhered to a belt surface. Preferably, a one-piece belt having spaced apart and movable lengthwise portions is used. Different transport velocities are used for web fed to the cutter and for labels taken-away from the cutter. Cutter motion, and thus label length, in forming either linerless and lined labels, is controlled according to how printed indicia bar marks on the web are severed into portions; alternatively, according to whether or not the cut falls between two spaced apart printed indicia. Linerless labels have die cut edge cutouts, so that when they are severed, round corner labels result. A rotary cutter anvil is internally cooled to help prevent linerless web adhesion; and the anvil and cutter are frictionally engaged, to rotate together.

22 Claims, 15 Drawing Sheets

CORRECTION ALGORITHM 1

CORRECTION ALGORITHM 3

FORMING AND APPLYING LINERLESS LABELS

This application claims benefit of provisional patent application No. 60/451,492 filed Mar. 3, 2003.

TECHNICAL FIELD

The present invention relates to forming and applying pressure sensitive labels to articles, particularly where the label is of the linerless type.

BACKGROUND

Linerless pressure sensitive labels have a first finished side coated with a release coating, and a second opposing side coated with a pressure sensitive adhesive. For mass production use, they are supplied as continuous web in the form of rolls. In one use, web is pulled from the roll, labels are cut from the web to the desired length, optionally printed upon, and then applied to the workpiece, typically an article or packaging for such.

Linerless pressure sensitive labels offer significant known advantages over older and more familiar lined labels. In lined labels, and in the web from which the labels are formed, the label stock, such as paper or plastic, is mounted by pressure sensitive adhesive on a liner, or a film of thin disposable material specially tailored for the purpose. After the label stock is peeled from the liner at the point of use, and the labels are applied to the workpiece, the liner waste is discarded.

Linerless labels provide certain advantages over lined labels, including more labels per unit volume, e.g., more labels per roll diameter, and no waste to dispose of. However, while linerless web and labels for various applications have been commercially available for a number of years, their use for labeling mass production consumer goods, or for applying postage stamps or other labels to parcels or other objects on a high speed volume basis, has been limited. It appears the situation is largely due to the lack of means for applying the liner-less labels reliably and precisely at high rates to conveyer-carried articles.

One problem associated with linerless labels is that it is difficult to handle web stock or labels, because the exposed pressure sensitive surface adheres to the parts of equipment that it contacts. Another problem, which is also applicable to lined labels, is to accurately cut and apply labels on a continuous high speed basis while avoiding downtime for adjustments or cleaning. Another problem is that labels are not always cut to the desired length on a continuous basis, due to factors such as inaccurate controls, slippage of web in a feeder, or stretching of the web due to effects of load imposed by the apparatus or atmospheric change The present invention overcomes many of the prior art problems and achieves the desired production capability.

SUMMARY

Figure 1:
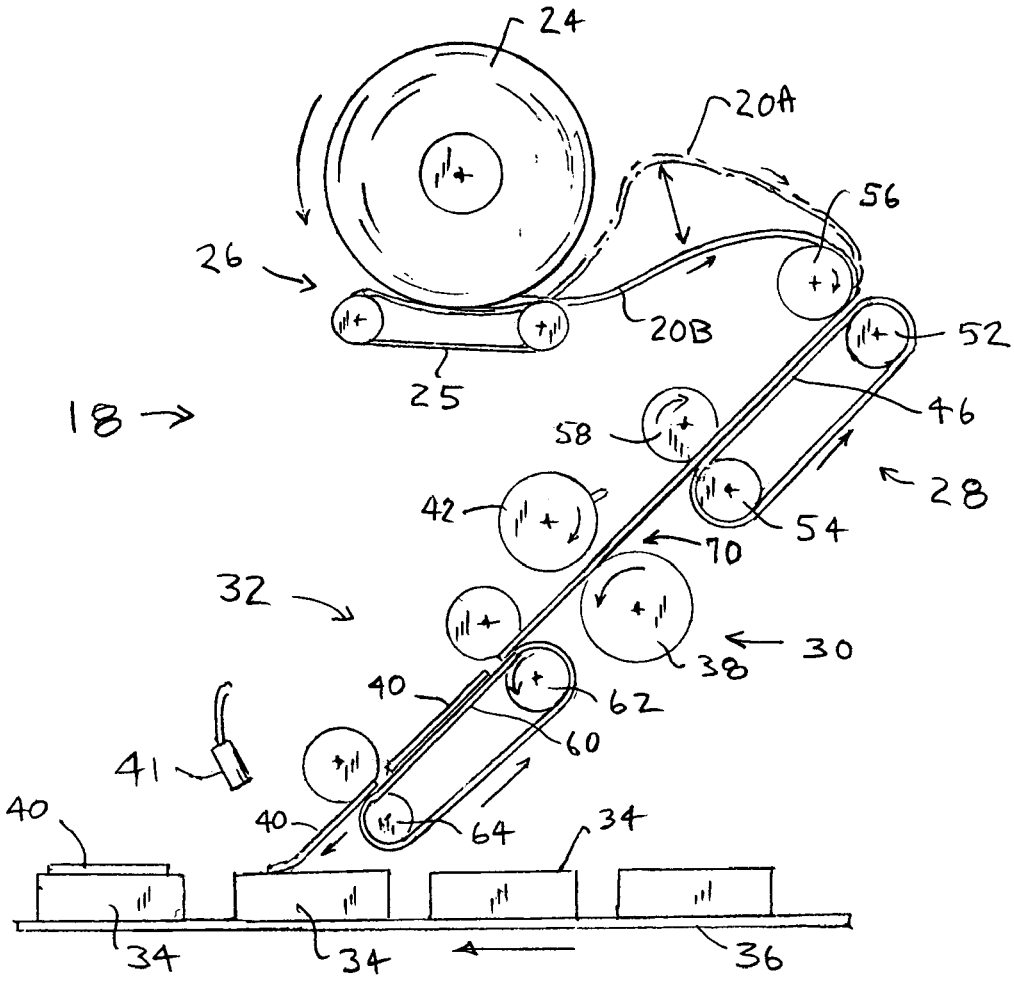
FIG. 1 is a side elevation view of apparatus for feeding, cutting, and applying linerless labels cut from a web roll

An object of the invention is to provide an improved method and apparatus for manipulating linerless web material, so the web may be severed repetitively and rapidly into small pieces, so they may be applied to articles as labels or for any other purpose. A further object is to avoid accumulation of adhesive debris and cleaning maintenance. Another object is to reliably cut labels to accurate lengths, and to verify that has been done, in high speed equipment, whether the web is linerless or lined. A further object is to minimize the cost and time of fabrication, maintenance, adjustment, and downtime in such equipment. A still further object is that any specialized web material be economic to manufacture.

In accord with the invention, web which is fed down a flow path to and through a cutter assembly, so it can be repetitively severed into labels, is contoured in a plane transverse to the flow path, to increase its stiffness as it is projected through the cutter assembly. When labels are taken away from the cutter, so they can be applied to an article by an applicator assembly, each label is likewise contoured, to increase its stiffness as it projects from the end of an applicator, to contact and adhere to an article.

In accord with the invention, web is moved downstream and contoured in a feeder assembly which alternatively comprises different configurations of endless belts running around spaced apart rollers. Likewise, the applicator, which transports labels away, uses the belts. In one embodiment, there are three spaced apart belts. The adhesive side of the web adheres to the center belt, helped by a pinch roller pressing on the release side. In a feeder assembly, the belts change elevation along the length of the feeder, so that the center belt is lower at the downstream end. That progressively makes the web, which is temporarily adhered to the moving belts, contoured in cross section—preferably concave. The applicator may have three belts also, with the center belt having elevation different from that of the two outside belts, so the contour of the web is carried forward into the labels. Preferably, the diameters of belts are sized relative to the downstream end roller diameter, to cause the outer fiber of the belts to elongate substantially, which helps break adhesion of the web or label to the belt.

In another endless belt embodiment, called a profile belt, a one piece belt cross section is comprised of a center land, and opposing wings at the edges, the belt contact area of the wing tips with the web is small compared to the land. When the lengthwise running wings are continuous, as compared to serrated, the wings flatten where the belt runs around a roller. Thus, as the belt of a feeder or applicator receives web at the upstream end roller, and the belt adhesive attaches to the land, preferably helped by a pinch roller, and the web then moves downstream, the wings rise up and contour the web (of the label in the case of an applicator). In another belt embodiment, an endless flat belt runs around a roller which has outer ends of larger diameter than where the belt runs around the roller. Thus, the outer edges of web adhered to the moving belt are raised up when the web runs to and across a roller. Pinch rollers or equivalent function structures are preferably used with all embodiments, to keep the center of the web adhered to the belt.

Preferably, the cutter assembly comprises a rotating knife cylinder and mating anvil which has a different circumference; the anvil and cylinder are spring biased toward each other, so rotation of one frictionally drives the other; and, the anvil is cooled below room temperature, to minimize a tendency of adhesive to adhere to the surface. Preferably, a rotary knife cutter cuts most, but not all of the way through the web; and, the linear takeaway velocity of the applicator is greater than the web feeder velocity. Thus, the remaining material at the cut location is severed by tearing as a result of the differential speeds. The cutter knife preferably has a peripheral velocity greater than the takeaway speed.

The control system uses indicia, such as small bars printed on the web surface, to enable control of where the cutter makes a cut, and to make all labels have the desired length within a tolerance. In one web marking embodiment, a lengthwise bar indicium is severed with each cut. A sensor downstream of the cutter reads the lengths of the severed indicia portions, compares the length relationships to a desired standard, for instance, that they should be equal. To the extent and according to the direction in which the portions are deviant, the timing of the cutter action or the speed of the cutter is adjusted, to change the location of a subsequent cut. In another web marking mode, two sets of indicia are spaced apart a lengthwise amount which defines a gap S, which is reflective of the label length tolerance. In proper operation, a label-forming cut is made within the gap. If one indicia or the other is instead severed, that deviation is sensed by a sensor downstream of the cutter; and, the cutter timing or speed is adjusted accordingly, to correct the deviation.

The invention achieves the aforementioned objects. It is useful for applying linerless labels to consumer products and the like which pass by the downstream end of the applicator at a high rate. It may be used for applying linerless stamps and the like. The control system features are useful for lined labels as well.

The foregoing and other objects, features and advantages of the invention will become more apparent from the following description of preferred embodiments and accompanying drawings.

DESCRIPTION

FIG. 1 shows mechanical components of labeling system 18 of the present invention. Linerless label material in web form 20 is converted into pieces to form labels 40 which are then applied to articles 34. The linerless label material has a pressure sensitive adhesive side, which faces inwardly when the web is wound as a roll 24, and an opposing finish side, which is release-coated to prevent good adhesion of the adhesive to the non-adhesive side, within the rolled web.

In summary, the system comprises a roll 24 or other source of material in web form; means for delivering the web 20 to a feeder assembly 28, which pulls on the web and feeds the web into cutter assembly 30 so the web projects through the cutter gap and onto the input end of an applicator assembly 32. When the cutter severs the web to form labels 40, the applicator 32 transports the labels to vicinity of the workpiece articles 34 moving on a conveyor belt 36 and applies the labels to the articles. The system is of the demand type, i.e., when the applicator contacts a label with an article, the upstream apparatus pulls web from the roll and readies the next label. For clarity of illustration, drivers, such as typical servomotors, are not shown, as they are within the common skill.

Web 20 is drawn from a roll 24 by frictional engagement of belt 25 of unwind unit 26 with the roll. Alternately, a single frictional drive unwind roller may be used. The web is conveyed to and received in the feeder assembly 28. This action intentionally causes a free loop 20A, 20B of web to be created. The free loop varies in dimension/path between locations 20A and 20B, as indicated by the double-headed arrow. As feeder 28 pulls web in, the loop will decrease in size to a predetermined minimum 20B, whereupon a signal form an unshown loop position sensor causes unit 26 to move the roll and unwind web faster than the intake rate of feeder 28, and to thus increase the loop size. In a steady state operation of applying labels, the unwind unit might run nearly continuously. Having a free loop results in minimum drag on the web being drawn into the feeder, which helps prevent slippage and possible lateral web drift in the feeder. Nonetheless, in an alternate embodiment, web 20 may pay off directly from roll 24 in a conventional manner, by passing over one or more combination of driven and nip rollers on a path running to the feeder assembly 28.

In the feeder assembly 28, web 20 is moved downstream along the flow path and simultaneously deformed in the transverse cross section plane by action of the endless transport belt(s), as detailed further below. When viewed in cross section transverse to the flow path, the web is contoured, preferably so the release side is made concave and faces upwardly, away from the belts 46, in FIG. 1. See also FIG. 4C. Web 20 is thus given increased lengthwise stiffness and made more resistant to lengthwise bending, so the web feeds well and accurately into the cutter assembly 30. As the concaved-web projects into and through the gap 70 of the cutter assembly, the cutter assembly repetitively cuts the web moving into contact with the applicator belt, to form individual labels 40.

The labels are then received and adhesively engaged by the applicator assembly 32, within which they are maintained and transported in concave condition.

Figure 2:
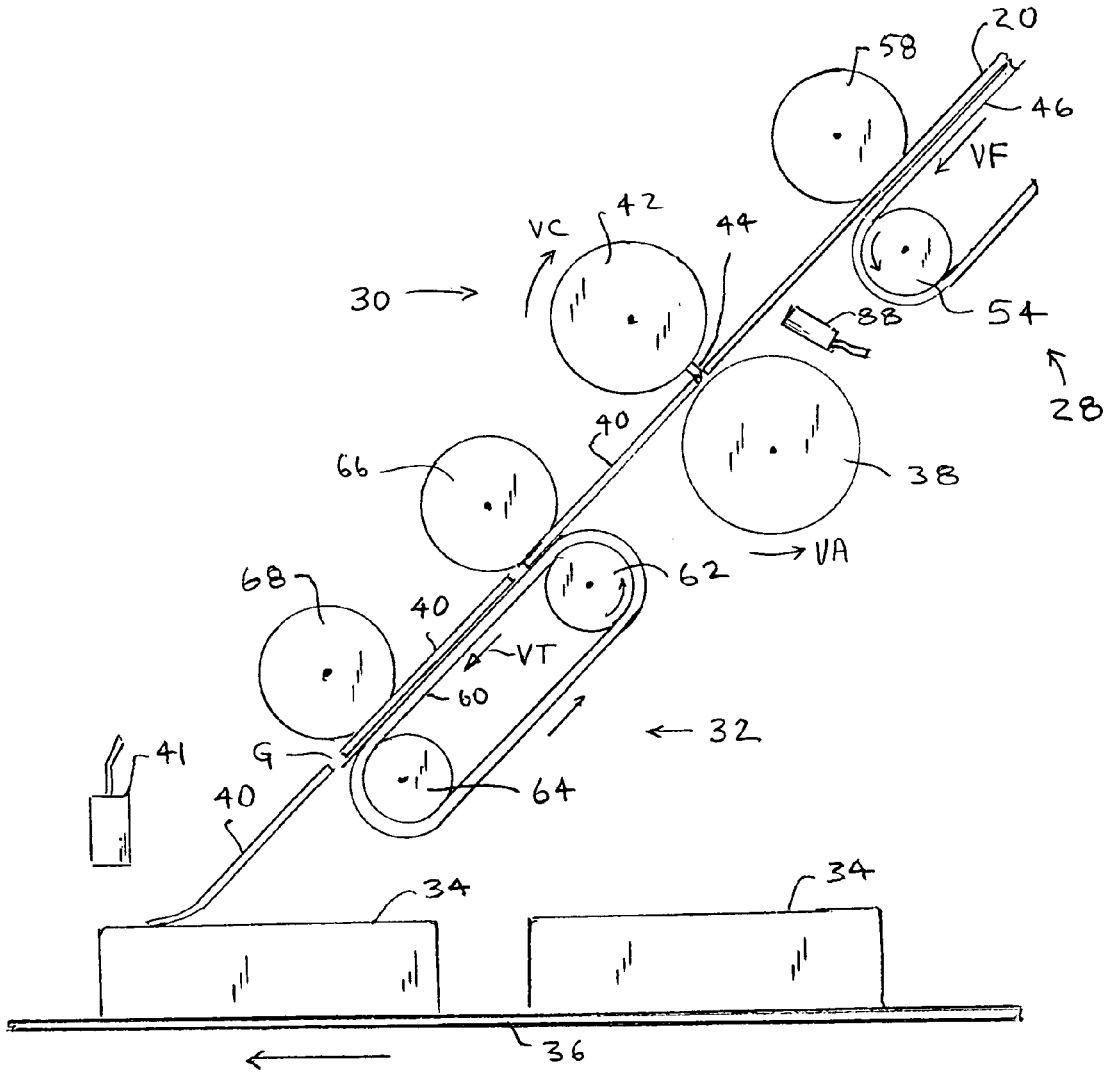
FIG. 2 shows portions of the apparatus in FIG. 1 in further detail.

As shown in FIG. 2 and FIG. 1, the leading edge of a concaved and therefore comparatively stiff label can be accurately cantilevered out from the lower end of the applicator assembly 32, toward the article conveyor 36. A proximity, photoelectric or other known type of sensor 41 detects the presence of each article 34, as it moves down conveyor 36. Responsive to a signal from the sensor, a control system commands a driver to move belts 60 of the applicator assembly 32. That advances the label 40 nearest the article 34, causing the leading edge to contact and adhere to the surface of the moving article. As the trailing edge of label 40 is discharged from the applicator 32, the label concavity relaxes, and the label is pulled downstream along the conveyor by the article. The article with label then passes through an unshown wiper or other known device, so that the label is pressed fully onto the article surface.

As shown in FIG. 2, cutter assembly 30 comprises rotatable anvil 38 and mating knife cylinder 42, which preferably holds one knife 44, which is replaceable, as known in the art. In a preferred embodiment, the knife contacts the release side of the web, to form a label from the web. The tip of knife 44 has a precise dimension relative to the anvil, so that when the knife cylinder rotates, the knife penetrates through the paper or plastic stock of the web, and at most part way into the adhesive, but insufficient to contact the anvil on which the web lies. Preferably, the knife penetrates only 80-90 percent of the way through the paper or plastic label stock of the material. And, as described below, the pulling action of applicator assembly 32 on the web which projects through the cutter assembly then tears the uncut remainder, and of course the underlying pressure sensitive adhesive.

Figure 14:
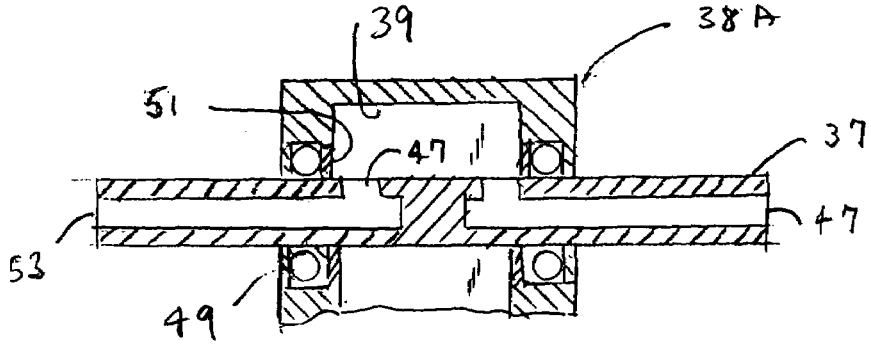
FIG. 14 is a partial diametrical cross section through a cooled anvil.

The properties of pressure sensitive adhesive vary substantially. If adhesion of adhesive to the anvil 38 is a problem, with accumulation of trace amounts of adhesive, then in the invention an anvil is cooled by through-flow of refrigerant fluid, such as an aqueous solution. Preferably, the anvil is cooled to a temperature substantially below the ambient dry bulb temperature, most preferably less than the ambient dew point temperature. For example, the anvil will be cooled to 35-40 degrees F. The formation of small amounts of atmospheric condensate on the anvil exterior is a desirable goal. FIG. 14 shows cooled hollow anvil 38A which spins on hollowed shaft 37 by means of bearings 49 having seals 51. Coolant gas or liquid is followed through blind bore 53 and port 47, to the hollow interior 39 of anvil 38A, exiting through a like port to flow out blind bore 47 on the opposing side of the shaft. In alternate embodiments, solid state electronic cooling devices within the cavity of the anvil may be used. In another alternative, the anvil surface may be surfaced with a coating with release characteristics, as described in the prior art, with or without the use of cooling.

Rotary motion of the knife cylinder is intermittent and coordinated with the motion of the web into the cutter gap, which is a function of label-demand. Thus, after cutting, the knife cylinder stops rotation, preferably so the knife will have to rotate about 270 degrees more to make the next cut. The knife will move again, responsive to a signal from optical sensor 88, which detects indicia, such as a printed line, beneath the translucent adhesive or on the release side. More detail is given below.

As each label 40 is formed and drawn away, the feeder assembly 28 advances the concaved web again through the cutter gap. The outside diameter of the knife cylinder 42 is small enough, so that when knife 44 is rotated away from the anvil, there is a (vertical) gap space between the anvil and knife cylinder, sufficient to enable the concave shape web to project through the gap, sufficient to reach roller 62 at the infeed end of applicator 32. Of course, the cutting knife action momentarily flattens the concavity of the web in vicinity of knife contact.

In an alternate embodiment, the positions of the knife cylinder and anvil are inverted and the knife contacts the adhesive side of the label, to penetrate and cut almost all the way through the material of the web. Developmental work has not shown a problem, but if there is cumulative adhesion of trace amounts of pressure sensitive adhesive on the knives, lubrication and cleaning techniques familiar in the prior art may be used. See. U.S. Pat. No. 4,978,415 to R. H. Jones.

The feeding of the labels by the applicator 32 is typically intermittent, but may be continuous. The action of the feeder, and the devices upstream, including the roll 24, are coordinated by a control system, responsive to the delivery of labels to articles 34. The curved arrows in FIG. 2 illustrate tangential velocities of certain components as they move. Peripheral velocity VC of the cutter knife tip is greater than linear velocity VF of the feeder transport belts 46, and thus the velocity of incoming web. Preferably, the velocity difference is about 20 percent. Linear takeaway velocity VT of the applicator belts 60, and thus the velocity of the label 40 which is cut from the web, is greater than VF, preferably by about 10 percent. Furthermore, the anvil circumference is preferably made slightly larger or smaller, for example 10 percent, than the circumference of the knife cutting edge path. Thus, with this feature the knife 44 will not mate with anvil 38 at exactly the same circumferential location on each rotation, and should there be inadvertent contact, any wear will be distributed on the anvil. Thus, generally $VF<VT<VC$ and $VC<VA$ (anvil surface velocity). And, preferably $VC\approx1.2VF$; $VT\approx1.1VF$; and $VA\approx1.1VC$. Preferably, one driver is used to power both the feeder and the applicator; and, the units are interconnected by appropriate belts and pulleys or gears, to achieve the desired speed relationships. A separate driver is used for the cutter assembly.

Since the tangential velocity of the knife cutting edge when it contacts the web is greater than the linear velocity of the web and the takeaway velocity of the label, knife 44 pushes slightly on the cut piece, i.e., the trailing edge of the label. Continued rotation of the knife cylinder lifts the knife from contact with the web. This provides a desirable wiping action which appears to lessen the adherence of adhesive, if the knife penetrates into the adhesive.

Figure 13:
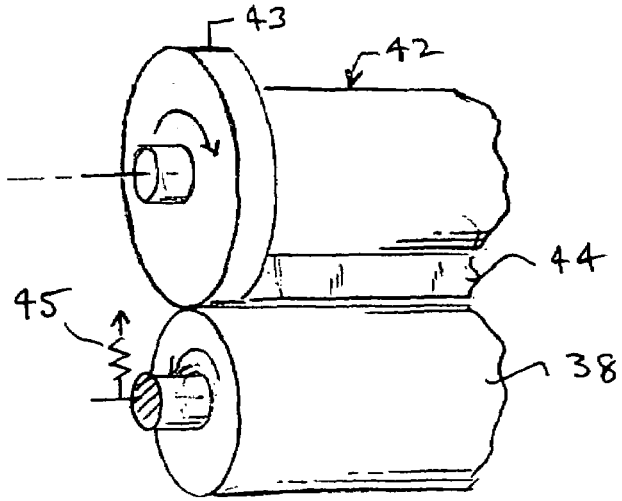
FIG. 13 shows a frictionally engaged and spring biased cutter and anvil combination.

With reference to FIG. 13, anvil 38 is preferably resiliently biased toward knife cylinder 42, by spring means, schematically illustrated by spring 45. The anvil contacts opposing side bearing rings 43 of knife cylinder 42. The anvil is thus rotated by frictional engagement when the knife cylinder rotates for cutting. Alternately, the anvil and the knife cylinder are rotatably interconnected by means of gears.

Figure 3:
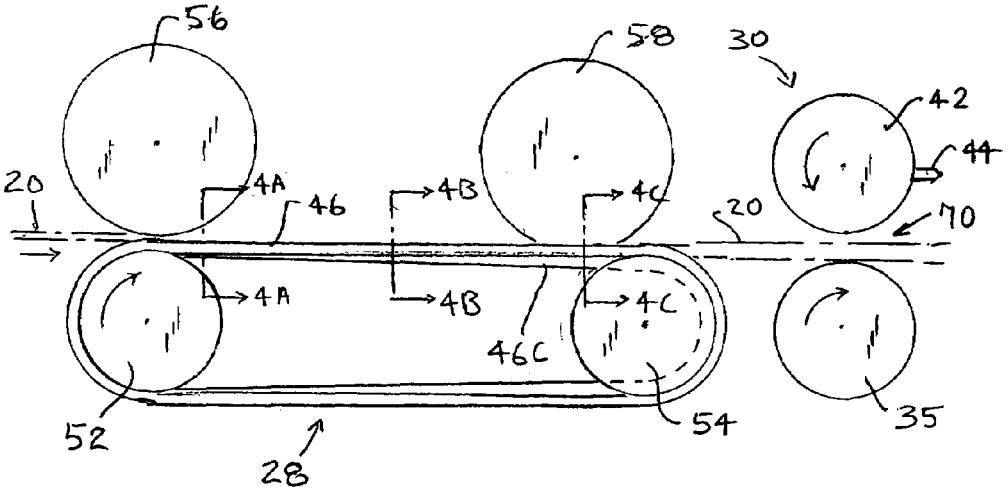
FIG. 3 is a side elevation view of the feeder assembly and cutter in FIG. 1, viewed from the opposing side.
Figure 4A:
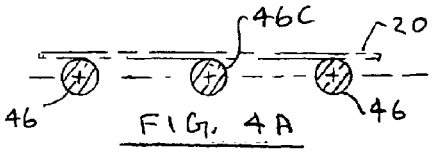
FIGS. 4A, 4B, and 4C show, in vertical, or transverse plane, cross section, the arrangement of the belts of the FIG. 3 apparatus, and how the web is contoured so it is concave looking down.
Figure 4B:
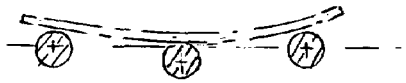

How the web and label are transversely contoured, preferably concaved, is now described. (Most drawings show the web and belts running horizontally. Thus, in an embodiment where web or labels are transported in a non-horizontal direction or vertical direction, the term "elevation" will be appropriately construed as transverse to the slope.) FIG. 3 is an elevation view of the transport system of the feeder assembly 28, seen from the side opposite that shown in FIGS. 1 and 2. Two endless outer belts 46 and an endless center belt 46C run over rollers 52, 54. FIG. 4 comprises a series of vertical cross section views 4A, 4B and 4C of the belts 46, 46C at different points along the path of the web 20, as indicated in FIG. 3. Upstream roller 52 has three equal diameter grooves to receive the belts 46. As shown in the end elevation view FIG. 12, downstream roller 54 has three belt grooves. The groove for the center belt 46C is smaller in diameter than the grooves for the outer two belts 46. Thus, elevation of center belt 46C is lowered relative from the elevation of the nominal or mean plane of the web flow path, and relative to the elevation of the two outer belts, which contact abutting but spaced apart regions of the web, which are preferably but not necessarily near the outer edges of the web. Roller 54 is comprised of three separate pulleys, 80A, 80B and 82. Center pulley 82 spins freely on the shaft 84 which positively engages and drives the other two pulleys, to avoid scuffing between the center belt and its pulley groove which would occur with a one piece pulley.

Figure 4C:
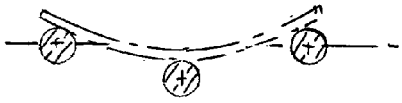

When the web 20 is laid on the belts at the input end of the feeder assembly 28, that is at roller 52, the adhesive of the web adheres to the belts, aided by pressure from upstream pinch roller 56, which is an idler and presses on the center portion of the web. See FIG. 3. As the web progresses downstream it is made increasingly concave, due to the changing elevation relationship of the belts to each other which is a result of the dimensions or output end roller assembly 54. Downstream end pinch roller 58, which has a depressed elevation that corresponds with the depressed elevation of center belt 46C, aids the concaving action. FIG. 4C shows how the cross section of the web 20 is changed. Preferably, the center of the web width is depressed about 8 percent of the web width. For instance, a 0.75 inch wide by 0.004 inch thick web will be depressed about 0.065 inch. The cross section of the web is changed from that of a flat beam to a smooth concave curve cross section beam. Thus, the section modulus and the moment of inertia of the web cross section are dramatically increased compared to those of a flat un-contoured web. Thus, when the web (or a label) is considered as a lengthwise beam, the stiffness, or resistance of the web/beam to lengthwise deflection is greatly enhanced. In this embodiment and others which use pinch rollers, the pinch roll may be powered, but is usually an idler. Other means for pressing the web against the belt, or pinching the web, may be used in substitution of a pinch roller. For instance, a curved shoe which glides along the surface of the web may be used.

Figure 12:
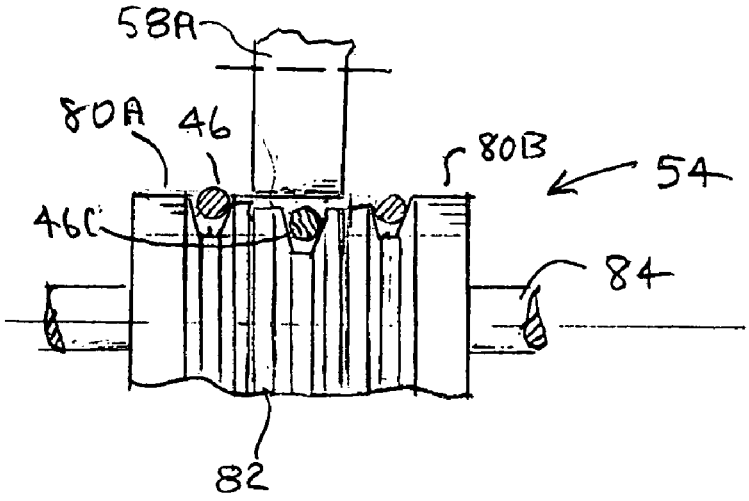
FIG. 12 shows the three-piece grooved exit roller, for the feeder assembly shown in FIG. 3.

Although there is some relaxation toward flatness, the concave condition of the web is substantially maintained as the web is cantilever-projected into and through the gap 70 of the cutter assembly, so that the web contacts the three belts 60 on the input roller 62 of applicator 32, and passes under pinch roller 66. See FIG. 2. The three belts of applicator 32 have substantially the same spatial relationship as shown in FIG. 4C. The input roller 62 and output roller 64 and associated pinch rollers 66, 68, have substantially the same shape and spacing as shown in FIG. 12. Rollers 62, 64 may be one piece rollers. Thus, concaved label 40 moves downstream, with its adhesive lightly adhered to belts 60, to the point that the downstream end of the label cantilevers out from the discharge end of applicator 32 and contacts and sticks to an article 34. Another benefit of the concaving is that the resultant lengthwise stiffness of the web and label causes the web or label to resist following the belt as it curves downwardly at the outfeed ends of the feeder and applicator.

Figure 5:
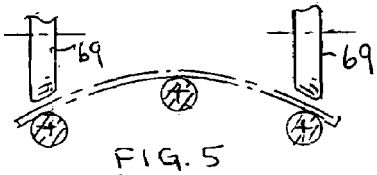
FIG. 5 is like FIG. 4C, showing a belt elevation arrangement which makes the web convex, looking down.

In an alternate embodiment, illustrated by FIG. 5, the web or label cross section is made convex, when viewed looking down onto the endless belts. Two pinch rollers 69 will be placed over outer belts 46, which are lower than the center belt, to press on the outer edges of the web or label. In the invention, there is contouring of a web or label in a plane transverse to the flow path direction. The contouring which increases the lengthwise beam strength of the web or labels may be other than the smooth concave or convex curve which has been described. More than three belts may be used. For example, the cross section of a very wide web/label may have a wavy or corrugated pattern, i.e., alternating concave and convex portions across the width of the web/label. In another example, the cross section of the web/label may be substantially V-shape; or it may be channel shape, i.e., where there is flat bottom with upstanding sides. The belts and associated pinch rolls would be appropriate in number and position, to achieve such different cross section contours. Smooth curves are preferred over the more abrupt contours, since it usually will be an aim to avoid imparting a set to the web or label.

Figure 6:
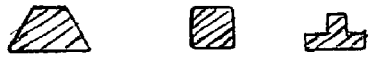
FIG. 6 shows alternative belt cross sections.

The belts are preferably circular in cross section. Alternatively, they may be trapezoidal, triangular, square or T-shape, as illustrated by FIG. 6. Preferably, the adhesive side of the web/label contacts the belts. Thus, the belts are made of commercial ether based polyurethane having a Shore A Durometer of about 70, to better accept adhesion of the typical pressure sensitive adhesive, while permitting relatively easy release at the exit end of the feeder or applicator, and while resisting buildup of transferred adhesive, with reasonable cost and durability. Preferably, round belts are about one-eighth inch (3.2 mm) in diameter. Belt material selection will vary with the characteristics of the adhesive of the linerless web.

Figure 7:
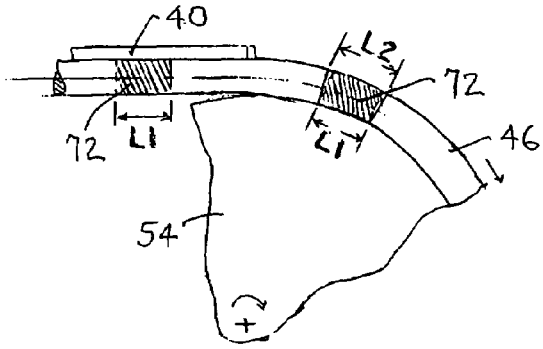
FIG. 7 shows in side elevation a portion of the feeder assembly of FIG. 3, to illustrate how the belt stretches when it runs around an exit end roller, to enhance release of an adhered web or label.

To further overcome the tendency for the web/label to stay adhered to the belts, the belt thickness with respect to the curvature of its supporting roller is sufficiently great, so that the outer fiber of the belt, where the label or web is adhered, increases significantly in length as the belt comes to and runs around a downstream end roller. This action is exemplarily illustrated in FIG. 7, for typical belt 46 of the feeder assembly at roller 54. The length of the outer (surface) fiber of imaginary segment 72 of the belt increases from L1 to L2 as the belt runs around the roller 54. Typical linerless label material of web 20 has a greater elastic modulus than a typical belt elastomer. Thus, if the web elongates at all in the apparatus, it will elongate less. The differential extension creates relative movement and breakaway shearing strain at the interface between the belt surface and the label, which defeats any firm grip of the adhesive to the belt. Preferably, the thickness of the belt and radius of the wheel are such that the elongation L2 relative to L1 is at least about 20 percent.

Thus, to recapitulate, the contouring and resultant lengthwise stiffening of the web/label, the surface property of the belt elastomer relative to the adhesive sticky-ness, the differential elevations of the belts, and the purposeful elongation of the belt at the discharge roller, separately and in combination make the apparatus effective and reliable in feeding linerless label material.

Figure 8:
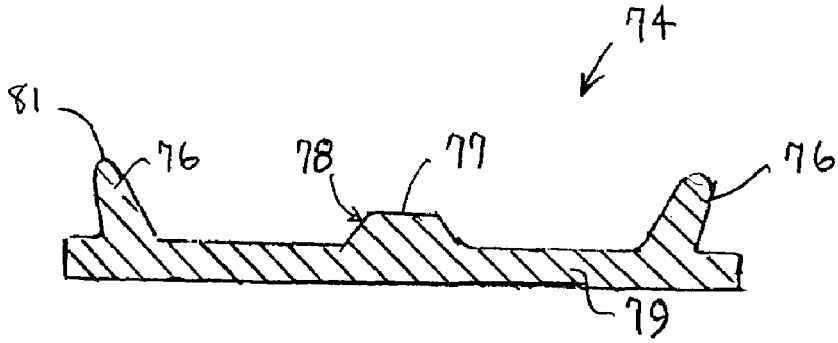
FIGS. 8, 9 and 10 show the cross section of a profile belt, for carrying web or labels, and how the belt configuration changes as it moves onto and off of end rollers.
Figure 11:
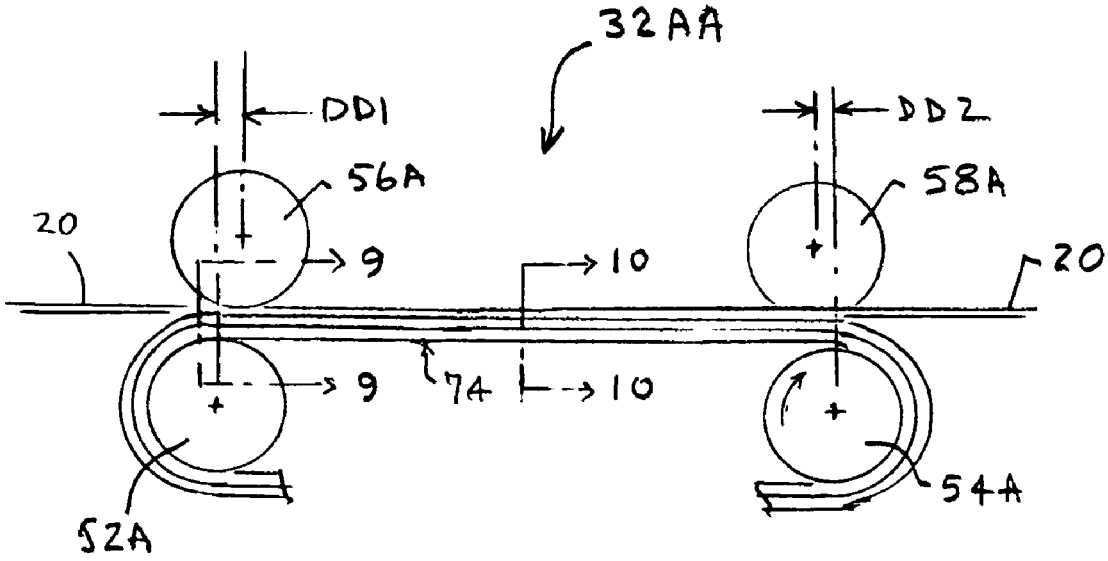
FIG. 11 is like FIG. 3, but shows the use of a profile belt like that illustrated by FIG. 8.

FIG. 8 shows the cross section of a profile belt 74, which is made of the same kind of material as the round belts 46, which may be used in substitution of the endless belt sets and rollers described above. FIG. 11, which is the same kind of view as FIG. 3, shows the belt on rollers of a feeder 32AA, for carrying web 20. Suffixes to numbers in FIG. 11 indicate parts which corresponding with previously described parts. The profile belt is also preferably used on the applicator to carry labels, so the commonality of description should be understood.

The underside of endless belt 74 preferably has an unshown lug configuration, characteristic of a typical timing type belt; and, rollers 52A, 54A have unshown serrations to match. FIG. 8 shows the configuration of the belt cross section in its natural or rest state, which is the configuration it has in space, between and away from the rollers. The belt cross section has a flat base 79 and opposing side angled cantilever wings 76. A trapezoidal cross section land 78 having a flat surface 77 for contacting the center of a web or label runs along the centerline. Surface 77 is large in web contact area compared to the narrow tips 81 of wings 76, which contact the web or label. This promotes greater adhesive force in the center. For example, the center land is about 0.07 inch (18 mm) wide and the web contacting width of the tips is about 0.007 inch (2 mm).

Figure 9:
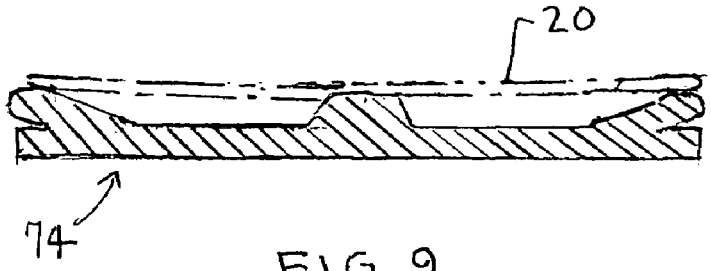
Figure 10:
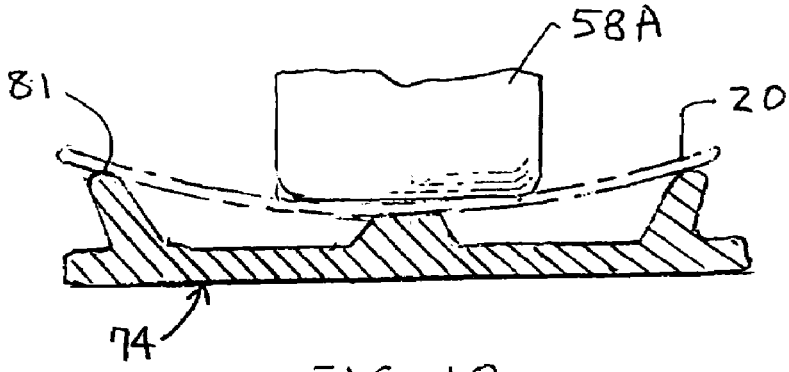

When running around the rollers 52A, 54A, profile belt 74 is subjected to the same outer-fiber phenomenon described for round belt. When the outer fibers are stretched, the resultant outer fiber tension in the wings 76 cause them to flatten out, as illustrated by FIG. 9. FIGS. 9 and 10 show web 20 in phantom, as it is self-adhered to the surface of belt 74. Preferably, pinch roller 56A presses onto the center of the web to push it against the land 78. Preferably, the width of roller 56A is a substantial fraction, preferably about 40-60 percent, of the span between raised wing tips 81, to help contour the web and keep it adhered to the center land. For example, the roller width is about 0.25 inch (6 mm) when the spacing between raised tips is about 0.5 inch (12 mm). Roller 56A and 58A are slightly inboard of the rollers which support the profile belt where they pinch, by distances DD1 and DD2 respectively. See FIG. 11.

As the web or label moves downstream off roller 52A and into space, wings 76 rise up, causing the web to become becomes contoured as shown in FIG. 10. The greater contact area and adhesive force at center land 78, abetted by the action or roller 56A, compared to the contact area and adhesive force at the wings, means any necessary slippage between the web and belt will occur at the wings. When the belt runs over exit roller 54A, the wings move laterally outwardly and downwardly, as illustrated by FIG. 5. However, the concavity and stiffness of the web or label due to the upstream contouring dominates and tendency for relaxation due to the lowered wings. Thus, as previously described, the web or label pulls away from the belt as the belt moves around the roller and the web or label continues to move in a nominally straight line, toward the cutter or article, as the case may be.

Figure 21:
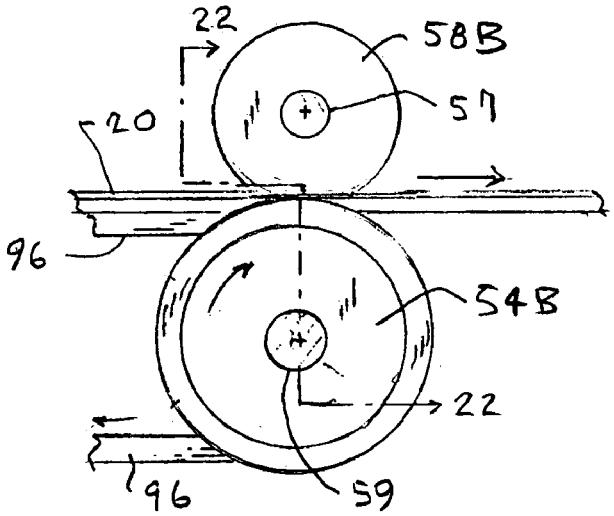
FIG. 21 is a side view of a roller with a flat endless belt, which is contoured by O-rings circumscribing the roller ends, with a pinch roller.
Figure 22:
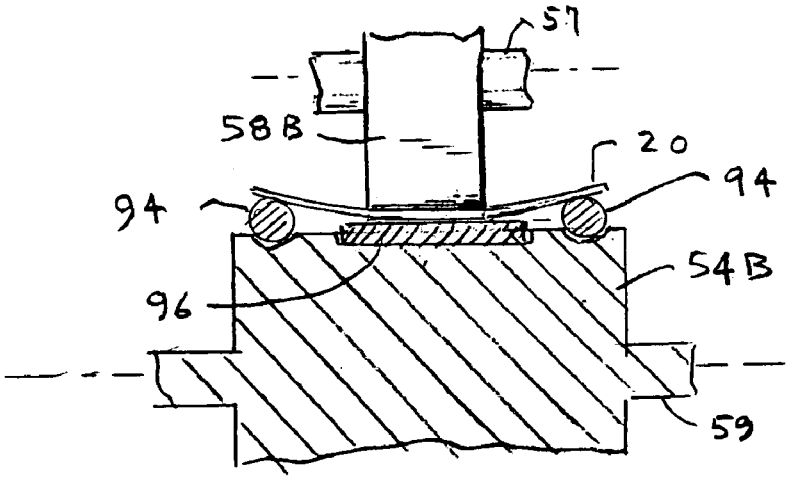
FIG. 22 is a partial cross section elevation view of the device of FIG. 21.

Another embodiment of means for curving the web or labels, while transporting them, is shown in the side elevation view of FIG. 21 and the partial cross section front elevation view of FIG. 22. (The FIG. 21 view is like FIG. 3.). Flat timing belt 96 runs around roller 54B and the adhesive side of the center of web 20 is pressed against the belt by pinch roller 58B supported on shaft 57. Roller 54B, driven by shaft 59, has opposing end circumferential grooves within which are o-rings 94, preferably made of silicone elastomer to minimize adhesion of the web. The outside diameters of the rings are greater than the outside diameter of the belt where the belt runs around the surface of the rollers. When the web is carried by belt 96 onto the roller, the o-rings cause the outer edges of the web to rise, to create the desired transverse plane curving. With reference the description above, a roller with O-rings will used at the downstream end of the feeder assembly, while the upstream end roller will have no o-rings. Two rollers with o-rings may be used in the applicator assembly in place of the other embodiments of the invention. In the generality of this aspect of the invention, a roller has other kinds of spaced apart circumferential rings, including for example, a roller having a surface which is machined with raised ends. While this embodiment is somewhat less preferred than the others, it is nonetheless found effective and useful. One or more intermediate rollers may be used, and in some instances the belt may be eliminated by placing a multiplicity of rollers 54B in close proximity along the flow path.

Other kinds of known cutters means may be substituted for the preferred rotary cutter systems described above. For instance, a guillotine cutter may be used, with the web motion being paused during cutting, or with the cutter translating downstream as the cut is made. In another example, web having perforated or scored joints may be severed into labels by a burster. Non-contact cutters, such as a laser or fluid jet may be used.

Figure 20:
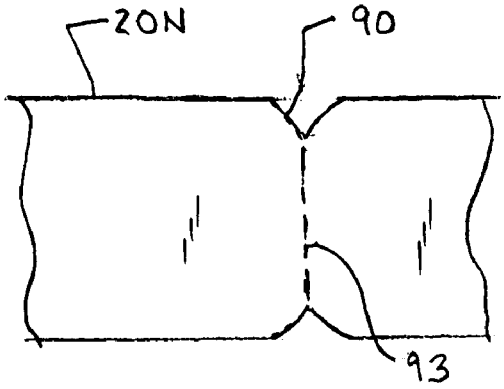
FIG. 20 is a top view of a piece of web showing edge cut outs.

Web may be die cut prior to passing through cutter assembly 30, so the labels produced have curved corners or other contour features. FIG. 20 shows in top view a portion of web 20N where curved cutouts 90 have been created by previous die cutting. When the web is in the cutter, a knife cut is made along dashed line 93, to form a round corner label, not shown. Alternately, the region of the web along line 93 comprises a series of fine perforations. And, the rotary cutter knife and anvil are replaced by a comparatively blunt edge reciprocating plunger, which presses deeply against the web, to burst-separate the label from the web. In still another burst-separator alternative, the cutout 90 may be omitted and perforated line 93 may run all the way across the web. For purposes of equivalency and claims, in this aspect of the invention a cutter assembly shall include a plunger type burster, as known in the art. See U.S. Pat. No. 5,862,968 of J. E. Traise.

As used herein, the term labels refers to any piece of material which is intended for adherence to an object, and is not limited to labels for packaging. Therefore, the term will comprehend postage stamps for adherence to mailing envelopes, and other applications of cut pieces of web. Labels may be cut to different lengths from the same web, with a suitable programming of the control system and suitable indicia placement. During use of the invention, web or label material may be printed upon by printing means positioned upstream of, or within the apparatus. For example, there may be a printer between the cutter and applicator.

The labels may be formed without being subsequently applied to an article. For example, labels may be received or dropped into a bin or magazine; or they may be received and simply transported away. In such instances, the receiver and transporter need not contour the labels. The method of transversely contouring the web, so it better cantilevers outward better, toward a cutter, may be used with lined labels. In the generality of the invention, a web can be contoured before being delivered to a feeder which carries the web to the gap of the cutter, rather than contoured within the feeder, by action of the belt system. For instance, a forming die with a contoured opening through which web passes may be placed upstream of the feeder and delivered to belts which have constant elevation, to maintain the contour. In another alternative, linerless labels, formed by another process which does not involve contouring of the web, may be contoured by an applicator, to obtain the benefits only in that step, which have been mentioned.

Figure 15:
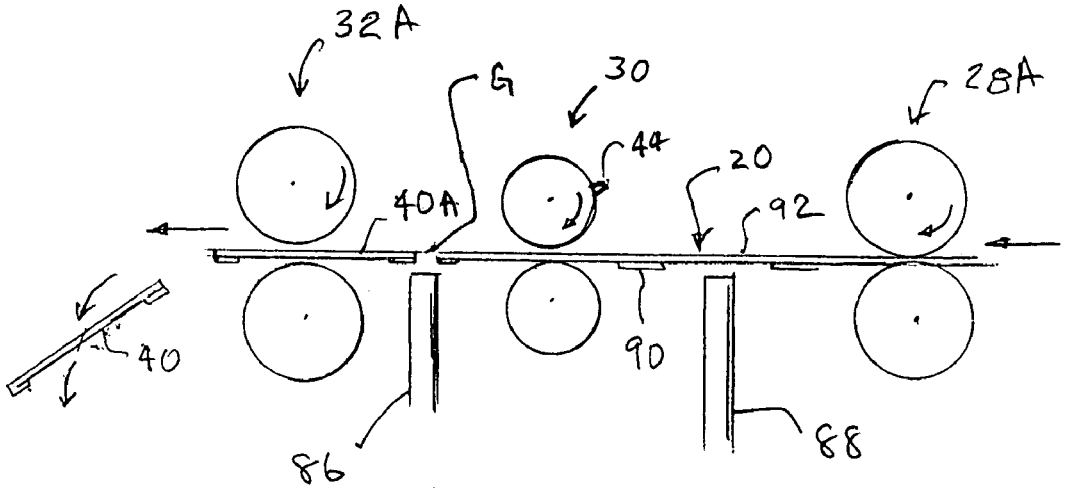
FIG. 15 is an elevation view.
Figure 16:
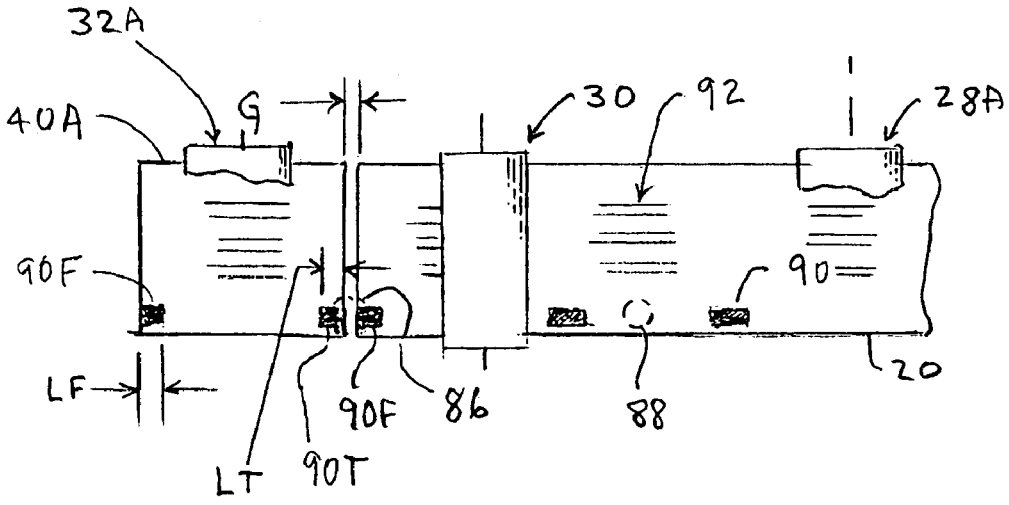
FIG. 16 is a top view, of a simplified system comprised of a feeder, cutter and takeaway, with sensors and web, to illustrate how certain indicia on the web are sensed and used to control cutting of labels.

FIGS. 15 and 16 show, respectively in elevation and top view, a simplified version of the FIG. 1 apparatus, to enable illustration of certain features of the control and function of the linerless labeling system. For simplicity here, feeder assembly 28 shown in prior Figures is represented by infeed roll assembly 28A; and, applicator assembly 32 is represented by output roll assembly 32A.

Web 20 is advanced through the gap of cutter 30 as previously described, and is severed into labels 40, which may have 2 inch (50 mm) length, for example. As previously described, the take away speed of rolls 32A is faster than the speed at which web is fed by feeder 28A into the cutter gap. The combination of feeding and takeaway motions creates a small gap G, for example of less than about 0.1 inch (0.25 mm), between the end of uncut web and the last-created label 40. The labels moving downstream within applicator 32 of FIG. 1 are likewise spaced apart. The speed at which labels pass through the applicator or output roll assembly 32A is a function of the rate at which labels must be delivered to the articles 34.

With reference to FIGS. 15 and 16, in a preferred mode of using the apparatus, web 20 which is drawn from roll 24 and moves down the flow path has printing 92 and associated printed indicia marks 90. Indicia 90 are severed into two portions 90F and 90F, by cutter 30. As described further, information acquired from the indicia by sensor 86, after severing, is used to precisely adjust when the cutter blade severs the label. The blocks of printing 92 and associated indicia marks 90 may be located on the same side of the web, or on opposing sides. In this and other embodiments, the label may be transparent or translucent so a mark on one side may be seen from the opposing side. In this example, all labels 40 are identical in length and printing 92 is centered on the label.

Indicia mark 90 is a lengthwise bar or other shape or symbol, which is printed on the web, at a known distance from location of product information printing 92. If the apparatus is used in a mode familiar in the prior art, a sensor 88 signals for cutter motion, when the moving indicia is sensed. Since the web speed and cutter timing are known, the web will be cut at a predetermined flow path distance position relative to where the mark is.

Figure 18:
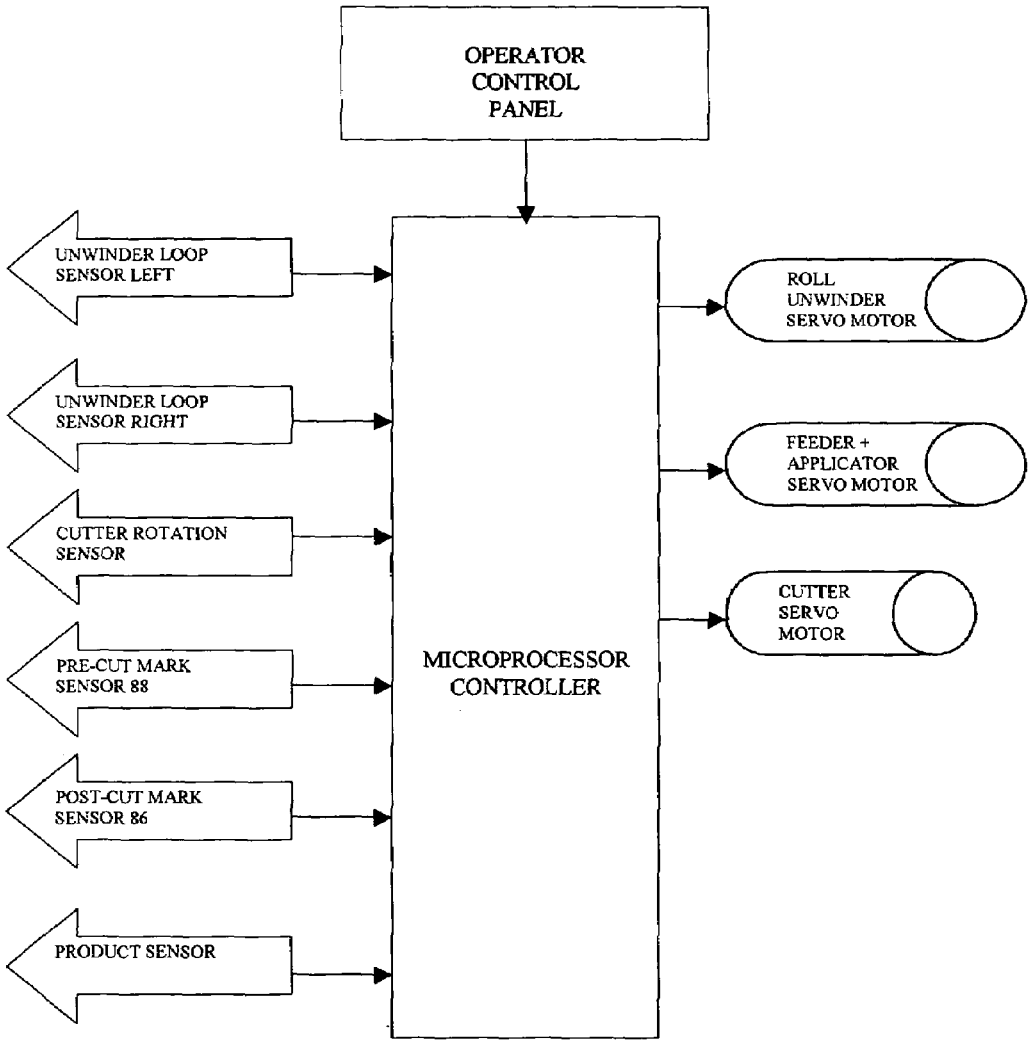
FIG. 18 is a schematic of the components of the control system.

Preferably, the motions of the roll assemblies 28A and 32A and cutter assembly 30 are controlled by servomotor drivers commanded by an electronic control system which responds to input signals from optical sensors 86, 88 and unshown encoders associated with the drivers of the roll assemblies. FIG. 18 is a schematic of the control system. FIG. 19A through FIG. 19F are flow diagrams for the function of the control system.

The function of mark 90 in this embodiment of the invention is to provide information about whether the labels have been consistently cut in length and in location relative to the printing, which function differs from the simplicity of timing mark which is used with sensor 88 only, as in the prior art, where the detected presence of a mark is used to trigger cutter action.

The FIGS. 15-16 system functions as follows: The rotary cutting action of cutter 30 is synchronized with the motion of the input rolls 28A. The surface speed of the output rolls 32A is a fixed percentage greater than the surface speed of the infeed rolls 28A, to achieve the differential speed of label and web, as above. When starting the system with a new web roll, the system is first commanded to cut when a predetermined amount of web has been advanced into the gap, based on manual input or sensor 88 input, so that mark 90 will be approximately severed into two equal segments. The predetermined amount is derived by means of an encoder signal from the infeed rolls.

Each time a label is created and moves downstream through the takeaway (applicator) rolls 32A, an optical sensor 86, downstream of the cutter 30, detects, and a processor computes and compares, the lengths of mark portions 90F and 90T, which are respectively at the front and trailing edges of a typical label 40A. A three or four label averaging of lengths is used. Preferably, sensor 86 has an electronic shutter, so there is no extraneous signal received from the label as it passes by the sensor, after mark portion 90F has been read, and before mark portion 90T is ready to be read. As an example, for a two inch long label, the shuttered mode will be the whole length of the label, minus about 0.2 inch.

In one mode of operation, the length of trailing mark fragment 90T of label 40A is compared to the length of front mark fragment 90F on the uncut web which extends through the cutter gap and toward applicator roll 32A. In another mode, mark fragment 90F and mark fragment 90T of the same label 40A are compared.

When fragments 90F, 90T, are measured and compared, the cutter is appropriately commanded in a way which will increase or decrease label length. For example the number of encoder counts from feed roll 28A, until the cutter starts to move, can be increased. That will increase or decrease the amount of web which advances into the gap of the cutter before the cut is made. For example, the speed of the cutter rotation can be changed, which has the same effect.

During continuous operation, the cutter will cut the constantly advancing web automatically, until some deviation in the equality of lengths of mark portions 90T, 90F is detected. Other than equal pre-defined length relationship of the severed portions may be used; or the length of one or more portions can be compared to a reference standard. For a web which is properly printed and in original condition, with uniformly spaced apart printing and indicia marks, the control system may not need to make any cutter timing changes. However, should the web have stretched in one region, for example, the cutter will hypothetically make 1, 2 and 3 cuts which produce deviant length labels. (It is assumed the deviation will be small and within the length of the indicia mark.) Then, based on the average of the deviations, or some other mathematical function, the control system will command that the relationship of the cut location relative to the web advance be appropriately changed.

In a variation from the foregoing, every label or every set of marks would not be sensed. For example, indicia marks are only sampled every n-th label, such as every other or every third label. In another variation, a certain amount of randomness could be programmed into the indicia mark sampling.

Optional sensor 88 is used for checking and verification purposes, and is not essential to the above described label length determination. For instance, upon setup, sensor 88 may look for marks 90 and compare them to previous control system reference information, so the apparatus will not be operated with the wrong linerless label web material. For example, if the apparatus operator inputs that the labels are supposed to be two inches long, sensor 88 may determine that the distance between marks 90 does not correspond, the system will not function. Similarly, if the web reel is exhausted, and sensor 88 detects no marks, the apparatus will be programmed to shut down.

Figure 17:
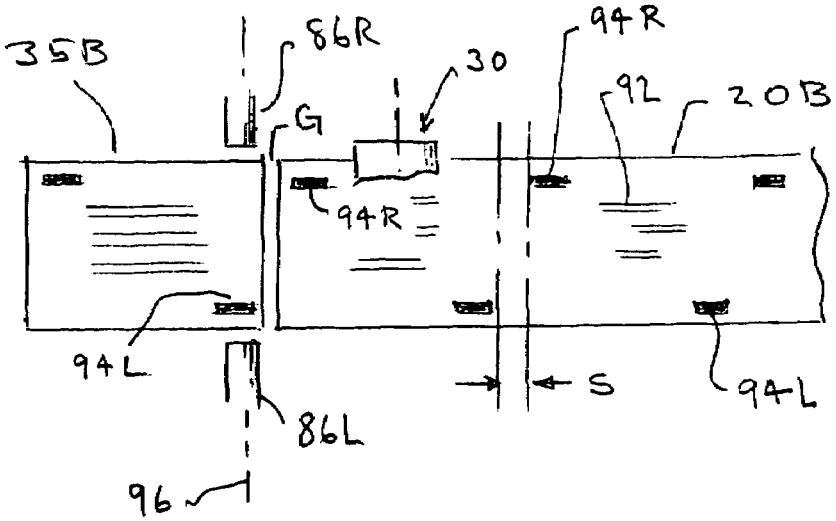
FIG. 17 is a view like FIG. 16, to illustrate an alternative web indicia marking and control method.

FIG. 17 shows another embodiment of the invention, in a simplified top view, similar to FIG. 15. One face of web 20B has a series of opposing side indicia marks 94L and 94R, precisely located relative to product printing 92. The marks are spaced apart a distance S. Another way of looking at the arrangement is that there are two sets of marks, with one being lengthwise staggered relative to the other by a distance S. Two opposing side optical sensors 86L, 86R (shown rotated out of position for illustration purpose) are located at transverse sensing plane 96, downstream of cutter 30. The sensors detect both the presence or absence of web/label material and the presence of absence of marks 94L and 94R, which have predetermined lengths and locations. No change in the timing and thus location of cut is made, so long as the cut lies within the space S. When that is the case, sensors 86R and 86L, never simultaneously detect any mark. However, the spacing of sensors is such that, if sensor 86R detects a portion of mark 94R while sensor 86L is still detecting a portion mark 94L, then there must be no gap G between the marks. The label is too long, and in reaction the control system commands cutter 30 to cut earlier, with respect to web advance. Other sensor locations and method variations may be employed within the essential method of cutting in space S.

Thus, as will be appreciated, space S is the tolerance band for length variation of labels 40, produced by the system. In an example, the label is about 2 inch long and S is about one-thirty second of an inch. This embodiment has an advantage over the embodiment of FIGS. 15-16 in that it has more of a go-no go aspect, and is less dependent on the fidelity of length measurement of the marks. Both sets of apart marks spaced apart by distance S may be placed on the same edge of the web, rather than on opposing edges.

The linerless label applicator system consists of a mechanical transport system along with the electronic control system, schematically shown in FIG. 18. FIGS. 19A to 19E show software flow charts, for use with the apparatus of FIG. 1 and other above described apparatus, and the indicia marking system described in connection with FIG. 15 and FIG. 16. The control system consists of a microprocessor which controls a three-servo motor arrangement that drives the feeder assembly 28, the applicator assembly 32, and the cutter cylinder 30. Various optical and proximity sensors are used to monitor the position of the linerless label web.

The controller comprises a microprocessor, such as a Rabbit Microsystems RCM 2020 device programmed in C language using Dynamic C version 7.26 from Zworld, which monitors various inputs and control the servo motors. The microprocessor is mounted on a board which contains I/O devices and the servo controller chips, to enable the microprocessor to communicate with the servo controllers of the servo motor drivers, and receive switch and sensor inputs. A control panel with switches and LCD display enables the operator to interface with the apparatus. There are the usual protective circuitry features and an emergency stop switch.

Momentary contact switches on the control panel start certain operations and set parameters. The switch functions are: THREAD, to start the threading of web through the apparatus; JOG, to perform one cut cycle when pressed; RUN, when pressed once, to start labeling under demand from the product sensor, and when pressed again, to return the system to an idle state; MOTORS OFF, to turn off servomotor power and make the apparatus dormant; INC, to increase an input parameter value; and, DEC, to decrease an input parameter value The controller consists of a microprocessor board connected to a machine interface board. The interface board comprises various I/O devices which monitor and drive the mechanism, three independent servo motor controllers with H bridge drivers, eight input ports for momentary contact control switches, six sensor inputs which have PNP type outputs two photocell conditioner circuits for passive emitter/detector type of reflective photocells.

A first servo motor drives the mechanically interconnected infeed assembly and applicator assembly, to move web 20 to and through the cutter assembly 30, where it is cut into labels 40, and to deliver the labels to articles 34. A second servomotor rotates the cutter cylinder 42, so the cutter knife cuts web into labels. Preferably, the motor drives the cylinder through one complete revolution per cut cycle. A third servomotor powers unwinder 26, to feed web from the roll to feeder assembly 28, and to maintain a loop of web 20A, 20B.

Two active reflective or proximity type sensors provide information about loop 20A, 20B to the system. Sensor 88, which is upstream of the cutter, is an active reflective sensor. One or more other active reflective sensors, not shown on the Figures, may be used to verify that labels are being delivered to articles and not jammed in the second conveyor or cutter unit. An active magnetic proximity sensor or reflective photocell which is used to sense the approach of the product on the supply conveyor and trigger a cut cycle to deposit one label on the product.

The principal software algorithms and related operator actions, for using the apparatus, are now described.

Figure 19A:
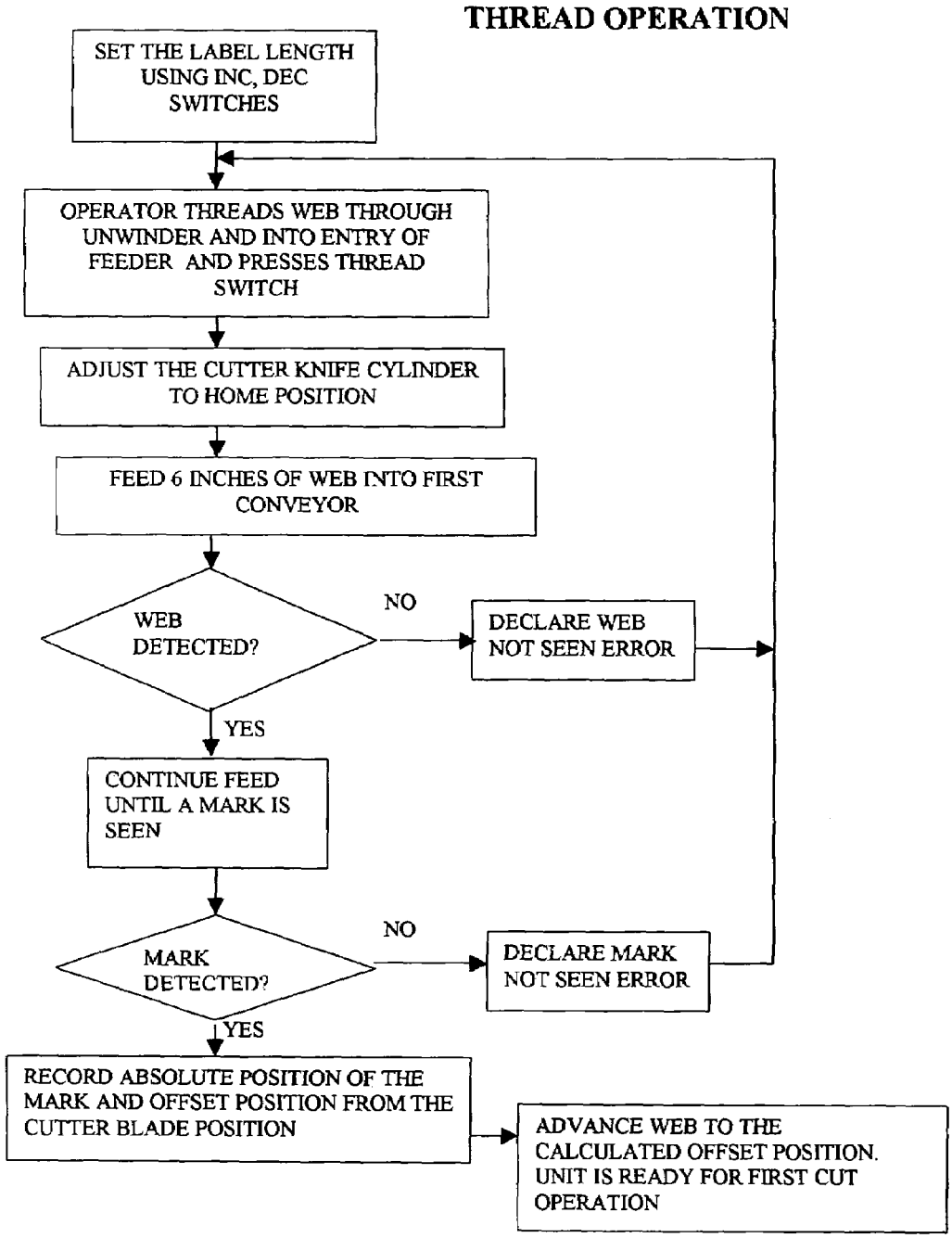
FIGS. 19A through 19F are flow diagrams to illustrate how the control system operates.

The first step is THREAD OPERATION, to setup the machine and thread the web into the feeder assembly 28 and gap of cutter assembly 30, so the unit is ready to start cutting labels. The operator first sets a nominal label length by means of the INC and DEC switches while reading the displayed value for length. Then, the operator manually threads the web through the unwinder mechanism, forming a loop and inserting the end of the web into the input end of feeder 28. The operator then presses the THREAD button and the software takes over loading the web into the feeder as illustrated by FIG. 19A.

Figure 19B:
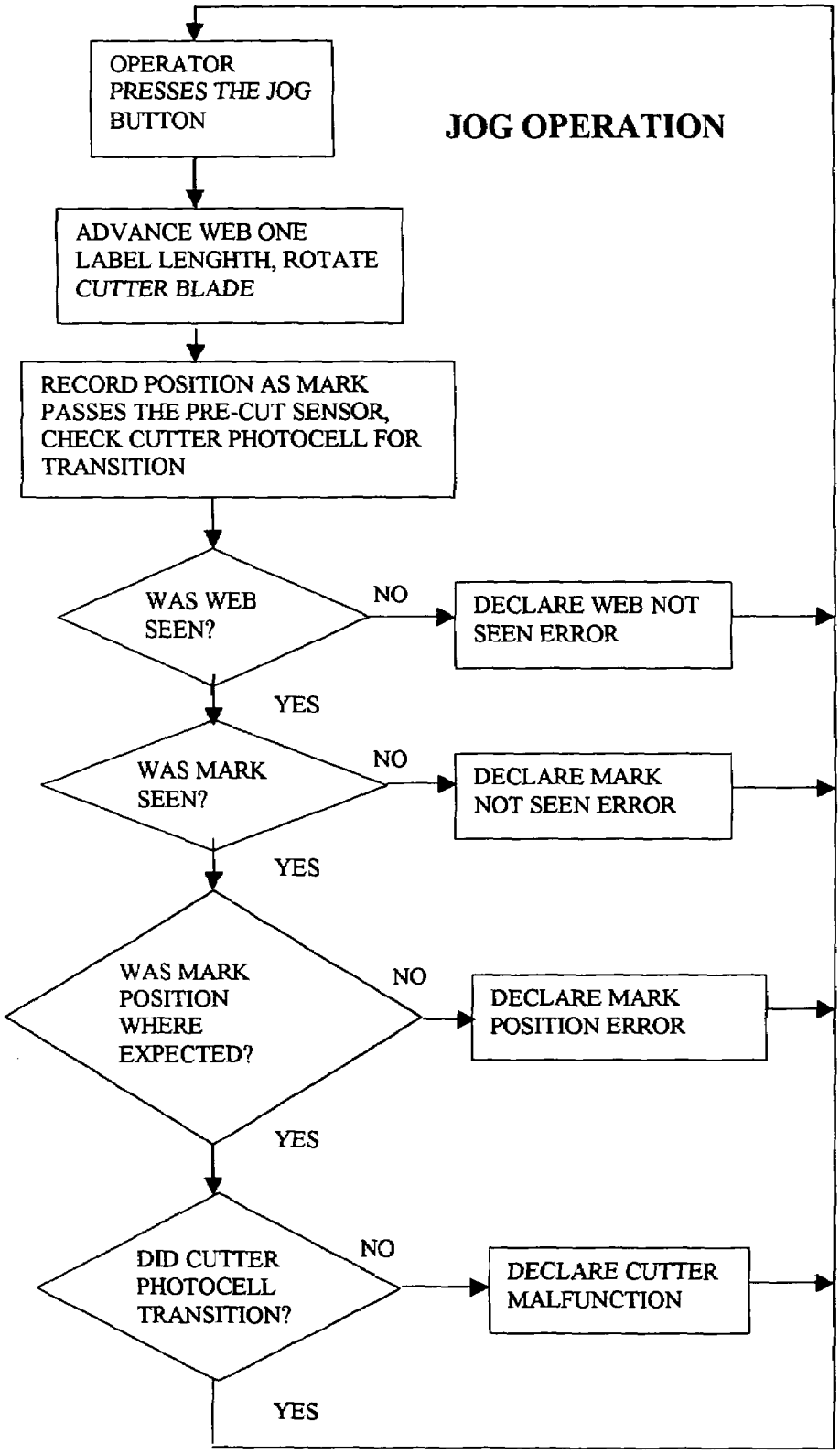

The JOG OPERATION, illustrated by FIG. 19B is the next step. It begins the cutting of labels from the web, and conditions the apparatus to accurately cut labels suitable for adhesion onto product articles 34. Each press of the JOG button caused cutting of a single label, so that the operator can verify visually that good labels are being cut.

Figure 19C:
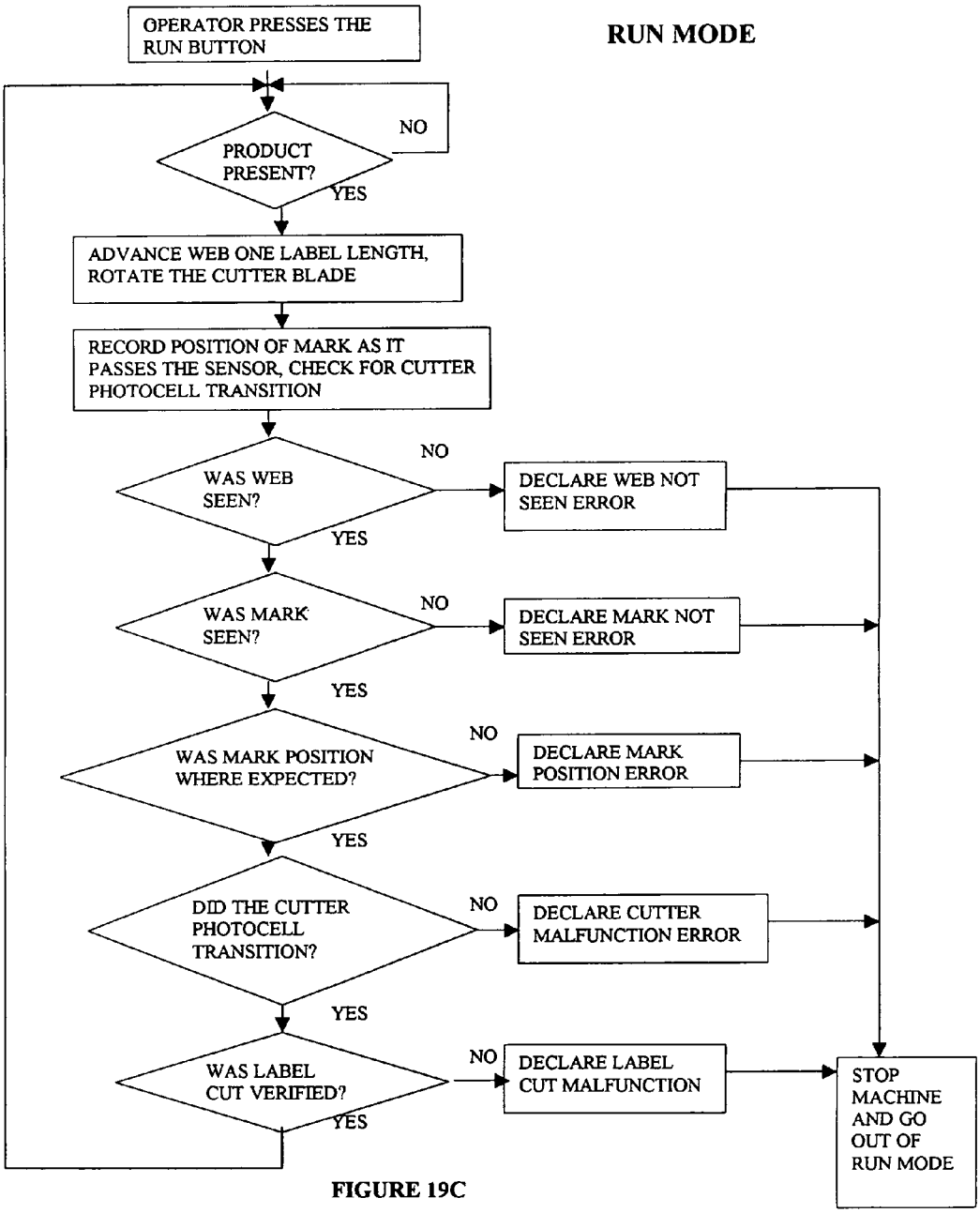

The next step, RUN MODE, illustrated by FIG. 19C, causes the apparatus to continuously cut and deliver labels, when product 34 is continuously presented by conveyor 36, ready to receive a label from applicator assembly 32. Any errors encountered during the RUN mode will cause the unit to stop and require operator intervention to restart.

The control system comprises a feedback loop to correct the amount of web which is fed into the gap of cutter 30, so the desired constant label length is obtained, should there be possible stretching of the web, slippage of the web on belts 46, 74, or other error inducing factors. At least one of two feedback loop position correction algorithms are used with the FIGS. 15-16 web indicia, as pictured in FIGS. 19D to 19E.

Figure 19D:
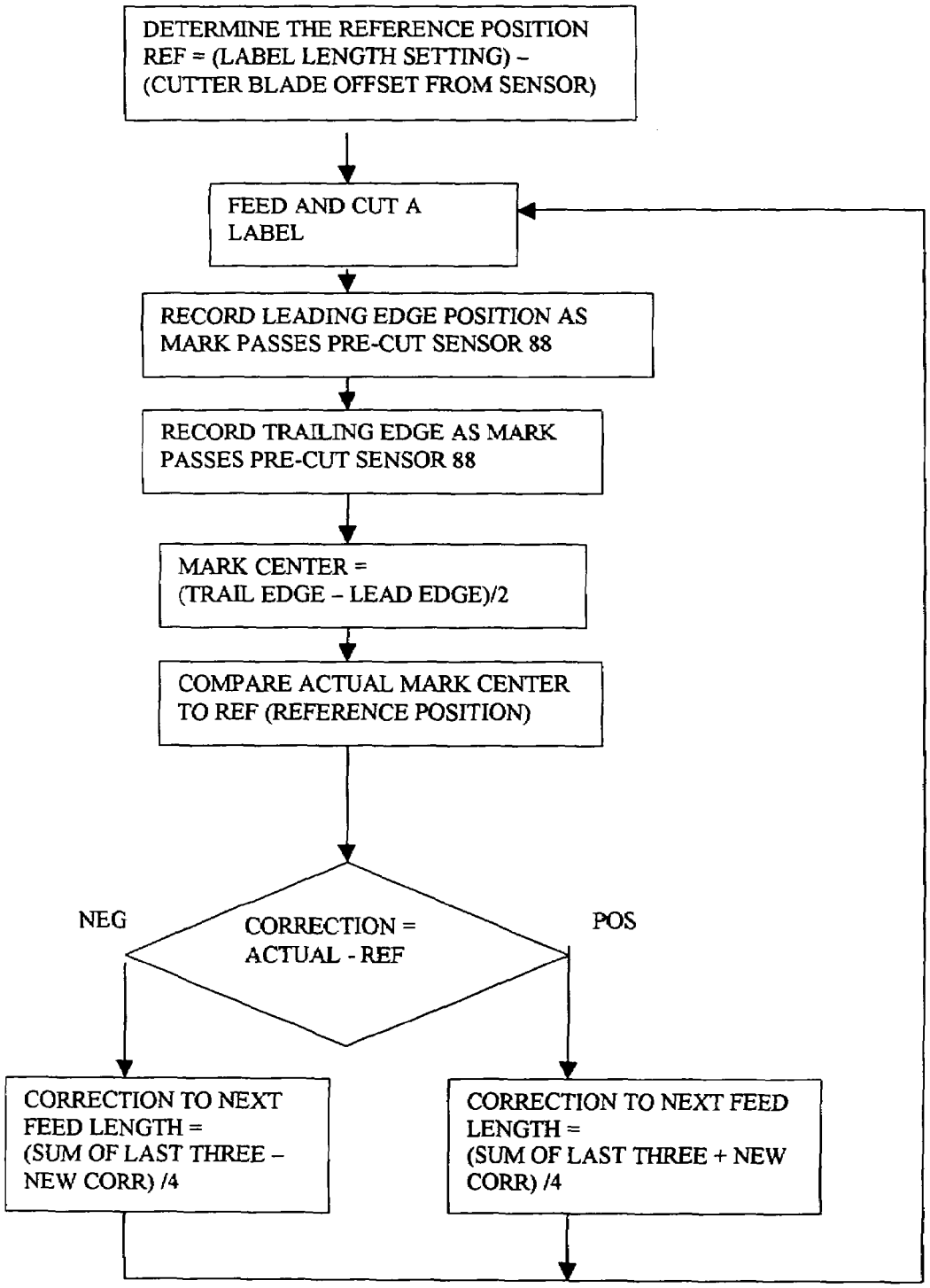

The first method of correction, illustrated in FIG. 19D, uses information from the reflective sensor 88, also called pre-cut sensor, to make a length correction. This method relies on the fact that the distance from the pre-cut sensor to the cutter knife 44, where it mates with the anvil and contacts the web, is fixed by the mechanical structure of the apparatus. As the web is fed into the cutter, and each label is formed by rotation of the cutter cylinder and action of the knife 44, the actual sensor detected position of the mark is compared to the expected (or virtual) position of the mark which is stored in memory. To the extent there is a deviation, an appropriate plus or minus correction is made for the next cut cycle, with respect to changing the amount of feeder assembly servo motor rotation, or changing the speed at which the cutter cylinder and knife rotates.

Figure 19E:
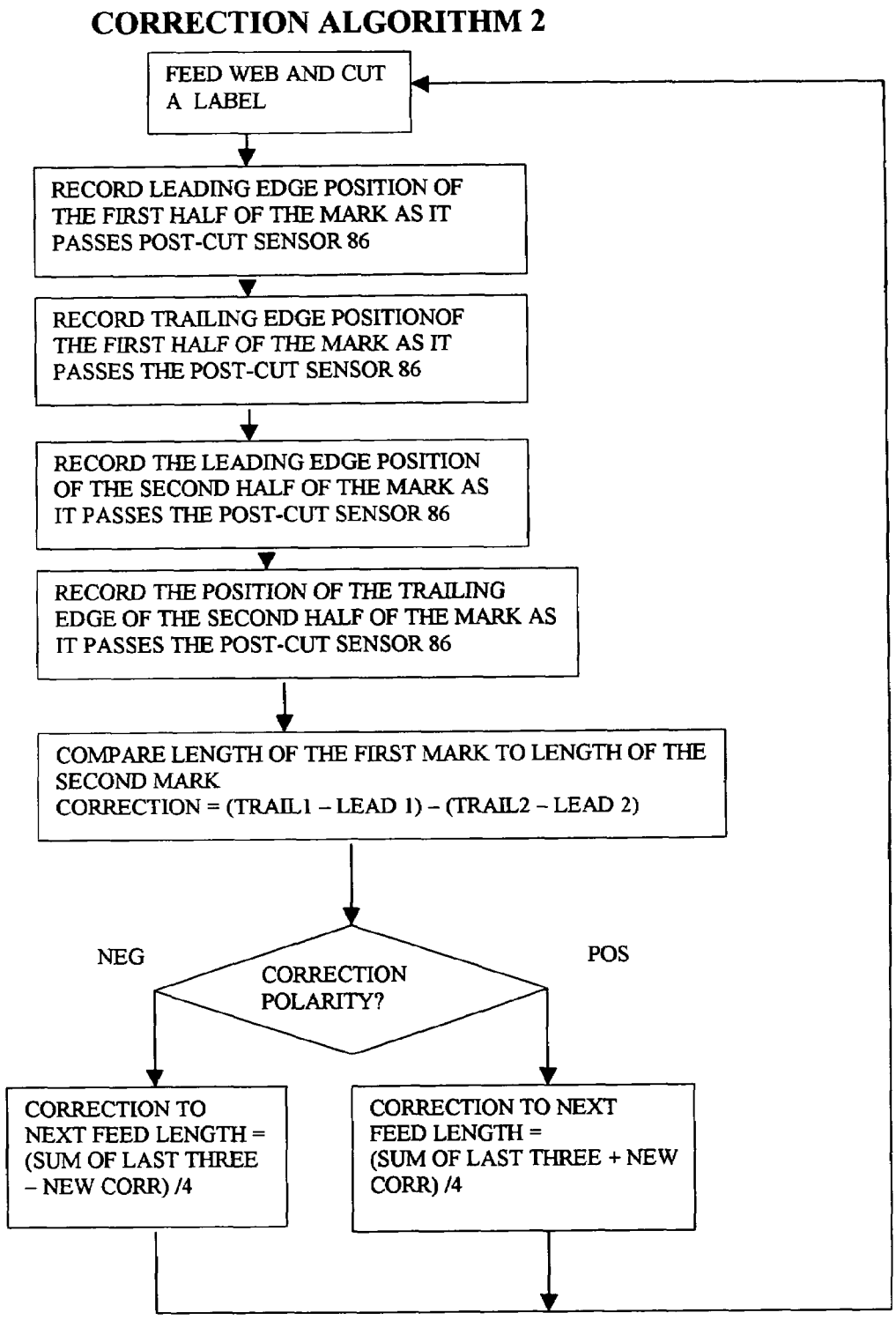

The second method of correction, illustrated by FIG. 19E, preferably uses a single thru-beam post cut sensor 86, to check the accuracy of the cut on a just-made label. The post-cut sensor measures the length of the two portions of the cut mark, as described earlier; and the control system makes any necessary correction in the amount of web which is next fed by the feeder assembly.

Figure 19F:
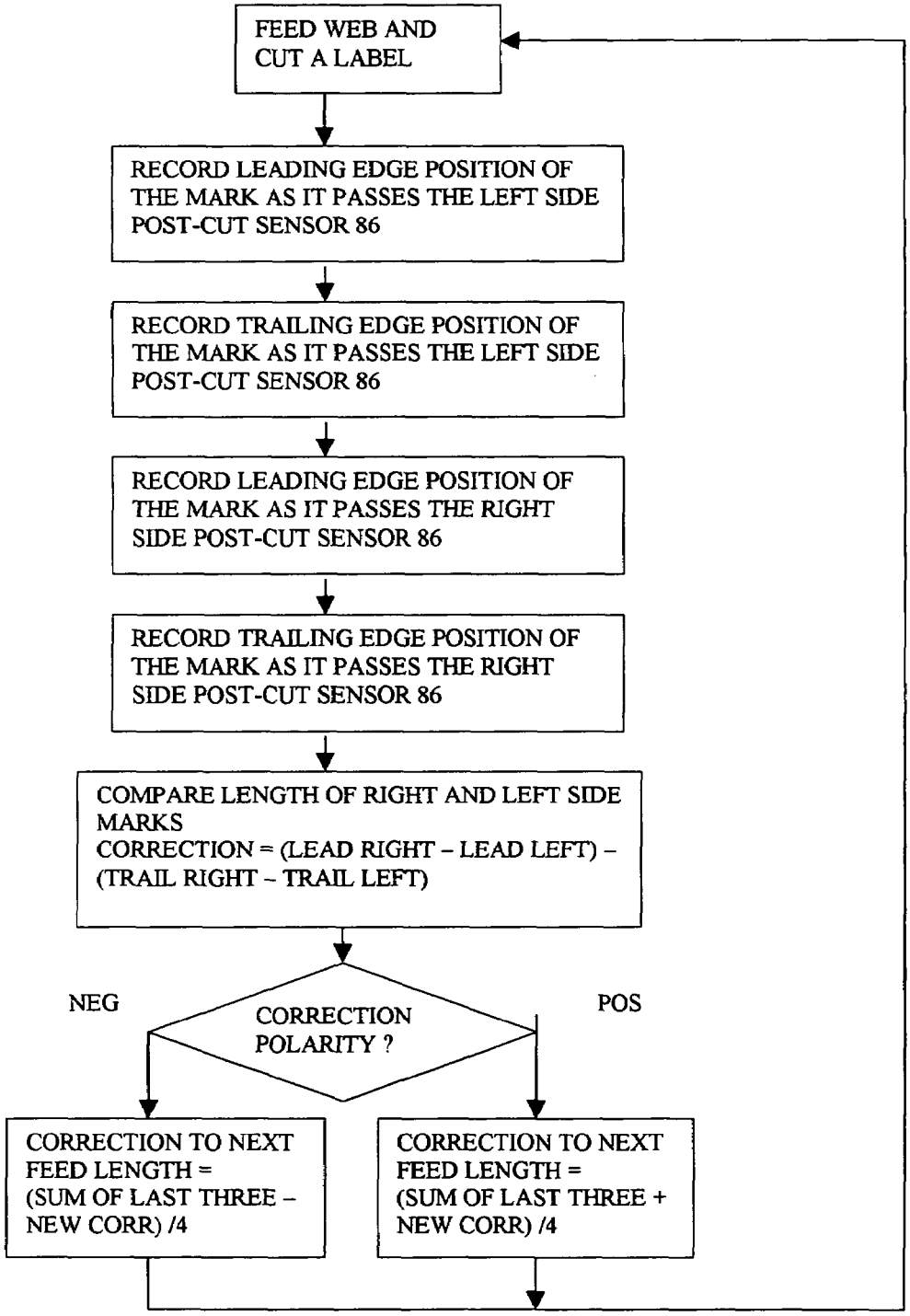

A third method of correction, illustrated by FIG. 19F, is used with the form of indicia which comprises marks on opposing sides of the web, which marks are offset or staggered along the length of the web. As previously described in connection with FIG. 17, any cut should be between the two marks, so that one mark appears on the first label and the other on the next label, as determined by two reflective post cut sensors, 86L and 86R, respectively on the right and left sides of the web. When the sensors show that not to be the case, the appropriate correction factor is applied to the next cut cycle.

In each of the three algorithms above, the correction value applied to the next feed cycle is the average correction value of the last four cycles. Using the correction value determined during each cycle on the next may lead to hunting and instability, hence the averaging provides a low pass filter to stabilize the feedback loop.

Within the ordinary skill, the foregoing algorithms and variations may at least in part be combined with each other for using an invention, and other algorithms for other purpose may be additionally employed. For example, the first method may be used to command the cutter motion and the second method may be used to verify that the cut length of the label is correct, as is the case when the machine is being set up and started, for continuous operation using the second method, in a preferred option.

In the generality of the invention: Other kinds of sensors and associated indicia marks may be used. For instance, vision cameras, magnetic ink sensors, charge coupled devices, etc. can be substituted for optical sensors. The indicia marks may be differently configured, for instance, less preferably, they may be punched openings. In any of the embodiments, the operation of the sensors that have been described, along with possible further sensors, may be combined with additional identifying marks on the label, beyond the indicia type marks. The control system of the machine would be programmed to only accept web material which had a certain imprinted proprietary pattern or design. This would prohibit operation with wrong or inferior materials. Labels may have no printing per se, but may be characterized by other finishes and patterns. The term printing as applied to web and labels here encompasses the generality of any finish on the label surface.

Although this invention has described with respect to one or more preferred embodiments, and by examples, they should not be considered as limiting the claims, since it will be understood by those skilled in the art that there may be made equivalents and various changes in form and detail, without departing from the spirit and scope of the claimed invention.

We claim:

1. Apparatus for forming linerless labels from web made of sheet material having a release side and a pressure sensitive adhesive side, which comprises:

means for feeding web along a flow path to a cutter assembly, for contouring web in a plane which is transverse to the flow path, and for projecting the web into space toward a cutter;

a cutter assembly, spaced apart from said means for feeding, for cutting the web repetitively, to form labels; and, means for receiving said labels from the cutter assembly;

wherein said means for feeding comprises (a) at least one set of rollers comprising an upstream roller and a spaced apart downstream roller;

(b) at least three spaced apart endless belts running between said set of spaced apart upstream and downstream rollers, for contacting, contouring, and moving web downstream along said flow path; wherein one of said three belts has a transverse plane elevation different from the elevation of the other two belts at some point along the flow path.

2. The apparatus of claim 1, wherein said means for receiving labels transports the labels away from the cutter assembly along a continuation of said flow path.

3. The apparatus of claim 2, wherein said means for receiving said labels contours the labels in a plane transverse to said flow path as the labels are transported away.

4. The apparatus of claim 2 further comprising: a source of web in roll form; and, means for delivering web from the roll to the upstream end of the means for feeding web, wherein the means for delivering causes the web to move along a free loop path.

5. The apparatus of claim 3, further comprising said sheet material positioned within the apparatus in the form of a portion of web contained within said means for feeding and in the form of at least one label contained within said means for feeding, wherein both the web and label have a convex shape when viewed from the release side of said sheet material.

6. The apparatus of claim 1 further comprising a portion of said sheet material positioned within the apparatus as a portion of web contained within said means for feeding, wherein said one belt contacts the lengthwise center of the web without contacting lengthwise-running regions of the web which are adjacent to said center.

7. The apparatus of claim 6 wherein said means for feeding comprises at least two endless belts, each spaced apart from opposing sides of said one belt, and the two belts running between the rollers at a first elevation; wherein the elevation of said one belt changes progressively in the downstream flow path direction from said first elevation at the upstream roller to a second different elevation at the downstream roller.

8. The apparatus of claim 1, wherein at least one of said belts runs around a part of the downstream end roller which has a diameter which causes stretching of the outer fiber of said at least one belt as it moves across the roller, to an extent sufficient to create breakaway strain on any adhesive bond between said at least one belt and the pressure sensitive adhesive side of web.

9. The apparatus of claim 1 wherein the cutter assembly comprises: a rotatable knife; an opposing rotatable anvil; and, means for cooling the anvil.

10. The apparatus of claim 1 wherein the cutter assembly comprises: a rotatable knife cylinder with knife; an opposing rotatable cylindrical anvil in contact with the knife cylinder; and, means for resiliently pressing together the knife cylinder and the anvil, so that cylindrical rotation of either rotates the other by frictional engagement therebetween.

11. The apparatus of claim 10 wherein the cylindrical surface of the anvil which mates with the knife cylinder during rotation of the knife cylinder has a circumference which is different from the circumference of the path of the tip of the knife, so that the knife tip mates with a different circumferential part of the anvil each time the knife cylinder is fully rotated.

12. The apparatus of claim 1, wherein said web of sheet material has indicia spaced apart along the web length, further comprising:

a first sensor, positioned downstream of the cutter assembly, for sensing indicia lengths;

means for comparing lengths of indicia which are severed during forming of a label, based on first sensor reading information; and, means for adjusting the length of a subsequent label, according to how the difference in lengths of an indicium which is severed during the forming of a label.

13. The apparatus of claim 1, wherein said web of sheet material has two sets of spaced apart indicia which are sensible by a sensor, the indicia sets arranged relative to each other to provide lengthwise spaces S between an indicia pair comprised of first set indicium and a second set indicium, further comprising:

a first sensor, positioned downstream of the cutting means, for sensing indicia lengths on the labels;

means for comparing the length of each indicia of a said indicia pair, as measured by the first sensor, with the predetermined known lengths of each indicia which on the web prior to cutting of the label; and, means for adjusting the length of the web which is subsequently cut into a label when a sensed length is less than said predetermined known length.

14. The apparatus of claim 12 or 13 wherein said means for adjusting comprises changing the amount of web which is fed along the flow path between the cutting of one label and the cutting of a next a label.

15. The apparatus of claim 12 or 13 wherein the means for cutting comprises a rotary knife cylinder and mating anvil; and, wherein the means for adjusting comprises changing the speed or timing of rotation of the knife cylinder.

16. The apparatus of claim 12 wherein the label length is changed according to whether or not there is equality in length of portions of any severed indicium.

17. The apparatus of claim 1, wherein at least one of said belts runs around a part of the downstream end roller which has a diameter which causes stretching of the outer fiber of said at least one belt as it moves across the roller, to an extent sufficient to create breakaway strain on any adhesive bond between said at least one belt and the pressure sensitive adhesive side of web.

18. Apparatus for forming linerless labels from web made of sheet material having a release side and a pressure sensitive adhesive side, which comprises:

belt means for feeding web along a flow path to a cutter assembly, for contouring web in a plane which is transverse to the flow path, and for projecting the web into space toward a cutter;

a cutter assembly, spaced apart from said means for feeding, for cutting the web repetitively, to form labels; and, means for receiving said labels from the cutter assembly;

wherein said means for feeding comprises:

an upstream roller and a downstream roller; and, an endless profile belt running around said rollers, for contacting said web, to move the web along said flow path and to contour the web in said transverse plane;

wherein said profile belt comprises (a) an endless belt base; (b) a central land; and (c) a pair of spaced apart opposing side wings; wherein the land and wings run along the length of the endless belt base and project outwardly from the endless belt base.

19. The apparatus of claim 18 wherein said wings are continuous along the length of the belt base, wherein when the belt contacts and runs around the surfaces of said rollers during use, the wings flatten toward the belt base.

20. The apparatus of claim 6, further comprising: means for pressing the web toward said one belt, as the web moves downstream in contact with the one belt.

21. The apparatus of claim 18 further comprising: means for pressing the lengthwise center portion of the web toward the central land of the profile belt, as the web moves downstream with the belt.

22. The apparatus of claim 21 wherein said means for pressing is a pinch roller having a width greater than the width of the central land of the belt.

* * * * *